US006257326B1

(12) United States Patent
Heinrich

(10) Patent No.: US 6,257,326 B1
(45) Date of Patent: Jul. 10, 2001

(54) COOLING ELEMENTS FOR SHAFT FURNACES

(75) Inventor: Peter Heinrich, Geldern (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/189,909

(22) Filed: Nov. 12, 1998

(30) Foreign Application Priority Data

Nov. 20, 1997 (DE) ..... 197 51 356

(51) Int. Cl.[7] ..... F28F 3/12

(52) U.S. Cl. ..... 165/169; 165/162; 165/168; 165/171

(58) Field of Search ..... 165/171, 162, 165/170, 169, 168, 177, 10

(56) References Cited

U.S. PATENT DOCUMENTS

| | | | | |
|---|---|---|---|---|
| 3,368,261 | * | 2/1968 | Pauls | 162/171 |
| 4,249,723 | * | 2/1981 | Kammerling et al. | 165/168 X |
| 4,620,507 | * | 11/1986 | Saito et al. | 165/168 X |
| 4,703,597 | * | 11/1987 | Eggemar | 165/171 X |
| 5,810,075 | * | 9/1998 | Deefe et al. | 165/171 X |
| 6,035,928 | * | 3/2000 | Ruppel et al. | 165/177 X |

FOREIGN PATENT DOCUMENTS

| | | | | |
|---|---|---|---|---|
| 2907511 | | 3/1986 | (DE) . | |
| 3925280 | | 2/1991 | (DE) . | |
| 0092033 | * | 10/1983 | (EP) | 165/171 |
| 1285420 | * | 1/1962 | (FR) | 165/171 |
| 353344 | * | 5/1943 | (HU) | 165/171 |

OTHER PUBLICATIONS

"Stahl Und Eisen", 106 (1986), No. 5, pp. 205–210.

* cited by examiner

*Primary Examiner*—Christopher Atkinson
(74) *Attorney, Agent, or Firm*—Friedrich Kueffner

(57) ABSTRACT

A cooling element for shaft furnaces provided with a refractory lining, particularly blast furnaces is made of copper or a low copper alloy and is provided with coolant ducts arranged in the interior of the element. The cooling element is composed of an extruded or rolled section which in the interior thereof has a plurality of cooling ducts which are round or have a shape which deviates from the circular shape. The cooling element is provided with lateral webs. The cooling element is equipped on the side facing away from the blast furnace wall in vertical direction with at least one continuous slag rib and the cooling element is equipped on the side facing the blast furnace wall with at least one fastening rib.

8 Claims, 8 Drawing Sheets

COOLING ELEMENTS FOR SHAFT FURNACES

BACKGROUND OF THE INVENTION

1. Field of the Invention

The present invention relates to a cooling element for shaft furnaces provided with a refractory lining, particularly blast furnaces. The cooling element is made of copper or a low copper alloy and is provided with coolant ducts arranged in the interior of the element.

2. Description of the Related Art

Cooling systems for the steel jackets of shaft furnaces, particularly blast furnaces, are extensively described in "Stahl und Eisen", 106 (1986), No. 2, pages 205–210. In addition to cooling with so-called cooling boxes, in recent years cooling with cooling plates, so-called staves, of cast iron and copper has been used increasingly.

DE 39 25 280 discloses a cooling plate of grey cast iron in which the cooling ducts are formed by cooling tubes which are cast into the cast body. This cooling plate has the disadvantage that, for preventing carburization, a coating of the cooling tubes is required which impairs the thermal flux from the hot side of the cooling plate or stave through the stave body and the tube wall toward the cooling water. Accordingly, such staves frequently reached high temperatures in excess of 760° C. at which decomposition of the pearlite occurs; cracks formed in the cast body and the cast material in front of the cooling tubes wears off even after a relatively short period of operation.

It has been attempted to achieve a longer durability of these staves of cast iron by casting a plurality of cooling tubes in the staves and to arrange these cooling tubes partially also in different planes parallel to the hot side. This made the staves of grey cast iron much more complicated and expensive, but the durability of the staves did not increase to the same extent.

A significant improvement were the so-called copper staves which are disclosed in DE 29 07 511 and are manufactured from rolled copper material, wherein the cooling ducts are produced by deep hole drilling parallel to the hot side. This makes possible an unimpeded thermal flux which is not impaired by any coating of the tubes. Copper staves of this type are significantly cooler on their hot sides than staves of grey cast iron, so that, contrary to staves of grey cast iron, a stable crust of burden material acting as insulation is formed on the hot side. This is the reason why copper staves, even though the thermal conductivity of this material is high, discharge less heat from a blast furnace than staves of grey cast iron.

Another advantage of the copper staves is the fact that they can be constructed thinner at about 150 mm than staves of grey cast iron at about 250 mm. Consequently, at a given size of the blast furnace, the useful volume is increased significantly when copper staves are used.

However, the decisive advantage of the copper staves as compared to staves of cast iron is the fact that they do not exhibit the formation of cracks because of the material properties and their surface wear is extremely low. In a long term experiment extending over more than ten years, a material loss of only 3 to 4 mm was observed. In the case of a rib height of 50 mm, this results in a computed service life of about 150 years which substantially exceeds the service life of the remaining blast furnace.

A disadvantage of the conventional copper staves is the fact that they are still constructed of relatively substantial solid material and, therefore, are heavy and expensive. The staves must be processed to a significant extent because of the necessary mechanical working on all sides, the cutting of grooves, the deep hole drilling and the welding of the pipe connections. The material removed by chip-removing processes constitutes a substantial portion of the total weight and can be sold only at a significantly lower price. Another disadvantage is the fact that when deep hole drilling is carried out in excess of 2 to 3 m depth, the duct diameters may not be less than a certain dimension because otherwise there is the danger that the drill runs off center. The cooling ducts produced in this manner are larger than necessary; the same is true for the quantity of cooling water because a minimum speed of about 1.5 m/sec is necessary for separating steam bubbles which may form at the tube wall as a result of the high thermal load. Consequently, the cooling water heating rates are uneconomically low.

SUMMARY OF THE INVENTION

Therefore, it is the primary object of the present invention to provide a cooling element which, contrary to conventional copper staves, uses significantly less material and requires less processing, while still being stable and able to withstand the rough operating conditions of a blast furnace, wherein the cooling element can be mounted easily and has a service life which is at least in the same order of magnitude as a blast furnace plant.

Another object of the invention is to provide a suitable flow cross-section for the cooling water which has a shape deviating from the circular shape in order to achieve greater heating rates for the cooling water without dropping below the necessary minimum speed for the cooling water which is required for separating and conveying away the steam bubbles which form at the tube wall at high thermal loads.

Finally, the hot side is to be configured in such a way that a surface is produced in an uncomplicated manner to which crusts of burden material can adhere well.

In accordance with the present invention, the cooling element is composed of an extruded or rolled section which in the interior thereof has a plurality of cooling ducts which are round or have a shape which deviates from the circular shape. The cooling element is provided with lateral webs. The cooling element is equipped on the side facing away from the blast furnace wall in vertical direction with at least one continuous slag rib and the cooling element is equipped on the side facing the blast furnace wall with at least one fastening rib.

In accordance with another embodiment of the present invention, the cooling element is composed of an extruded rectangular section having a groove and an extruded rectangular section having a key. Cooling ducts are arranged in the sections. The sections can be closed with an upper cover and a lower cover, wherein in the upper cover and in the lower cover each is laterally placed a pipe piece which is connected to the cooling ducts of the cooling element.

While a conventional copper cooling element usually has four parallel cooling ducts which extend in a copper block parallel to the hot side, the cooling element according to the present invention is composed of an extruded or rolled copper section having an appropriately selected length, wherein the section has one or more cooling ducts which are round or have a shape deviating from the circular shape. By providing appropriate ribs which extend from the cooling duct or ducts, the extruded or rolled section has a sufficient stiffness necessary for withstanding the rough operating conditions of a blast furnace; this refers particularly to the fastening rib or ribs arranged on the cooling element on the side facing the steel jacket of the blast furnace. The ribs also serve for fastening the cooling element to the steel jacket of the blast furnace. The lateral webs of the copper elements extending parallel to the steel jacket of the blast furnace ensure that the complete surface area of the steel jacket of the blast furnace is protected. The width of the webs is selected in such a way that they overlap or extend flush with the corresponding web of the neighboring element. This makes it possible to also compensate for the diameter or circumference differences in the conical portions of the steel jacket of the blast furnace, i.e., at the bosh or the shaft. The slag ribs on the hot side facing the interior of the furnace are mechanically finished in such a way that they facilitate the formation and stable adherence of a layer of solid or pasty burden materials to the hot side of the copper cooling elements.

The copper cooling elements can be cut to the correct length and bent on the construction site near to where they are to be assembled. For this purpose, the lateral webs at the upper and lower sides of the individual copper cooling elements are separated or removed by sawing, grinding or flame cutting, the remaining circular or non-circular duct cross-section is bent accordingly and is guided through the appropriate throughopening in the steel jacket of the blast furnace. The cooling elements are connected to the cooling circuit of the blast furnace through intermediate pipe pieces for the cooling water flow. In order to achieve diameters of the steel jacket openings which are as small as possible, the duct cross-section within the steel jacket of the blast furnace and outside thereof are returned by cold shaping back to the round cross-section.

For fastening the cooling elements to the steel jacket, the cooling elements are provided with bores in the ribs extending toward the steel jacket; support elements attached to the steel jacket of the blast furnace engage in these ribs; the connection between the ribs and the support elements is effected, for example, by inserted and secured pins or bolts. After the mechanical assembly, a refractory substance having a low thermal conductivity is filled in the conventional manner into the space behind the copper cooling elements.

In the alternative embodiment of the present invention, rolled or extruded copper sections are also used, wherein these copper sections are rectangular and have at the sides thereof a groove and key for an engaging connection between the cooling elements.

By joining several such elements together, a continuous copper block is formed with rectangular cooling ducts in the block. This configuration of the cooling element sides results in a seamless transition between the individual structural components which is utilized for compensating for the conicitiy of the blast furnace shaft and the blast furnace bosh. Consequently, a continuous heat protection of the steel jacket of the blast furnace is ensured.

Placed at the front ends of the cooling elements are similar extruded sections having a U-shape, but with a greater cooling duct cross-section. The cooling water enters and is discharged through a pipe piece each at the upper portion and the lower portion of the combined cooling element. Because the box-shaped sections have to be joined together and the head and foot pieces have to be manufactured, a cooling element constructed in accordance with the present invention requires somewhat more material and is somewhat more difficult to manufacture, however, the cooling element according to the present invention is even flatter than the copper cooling elements with the pipe cross-section or cross-sections and the attached ribs and, therefore, can be adapted essentially to the curvature of the furnace wall.

The cooling element can be attached to the furnace wall in a conventional manner by means of threaded blind-end bores in the cooling element and by fastening screws extending through the steel jacket of the furnace which can be made to be gas-tight at the outer side by welding cover cups thereon.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
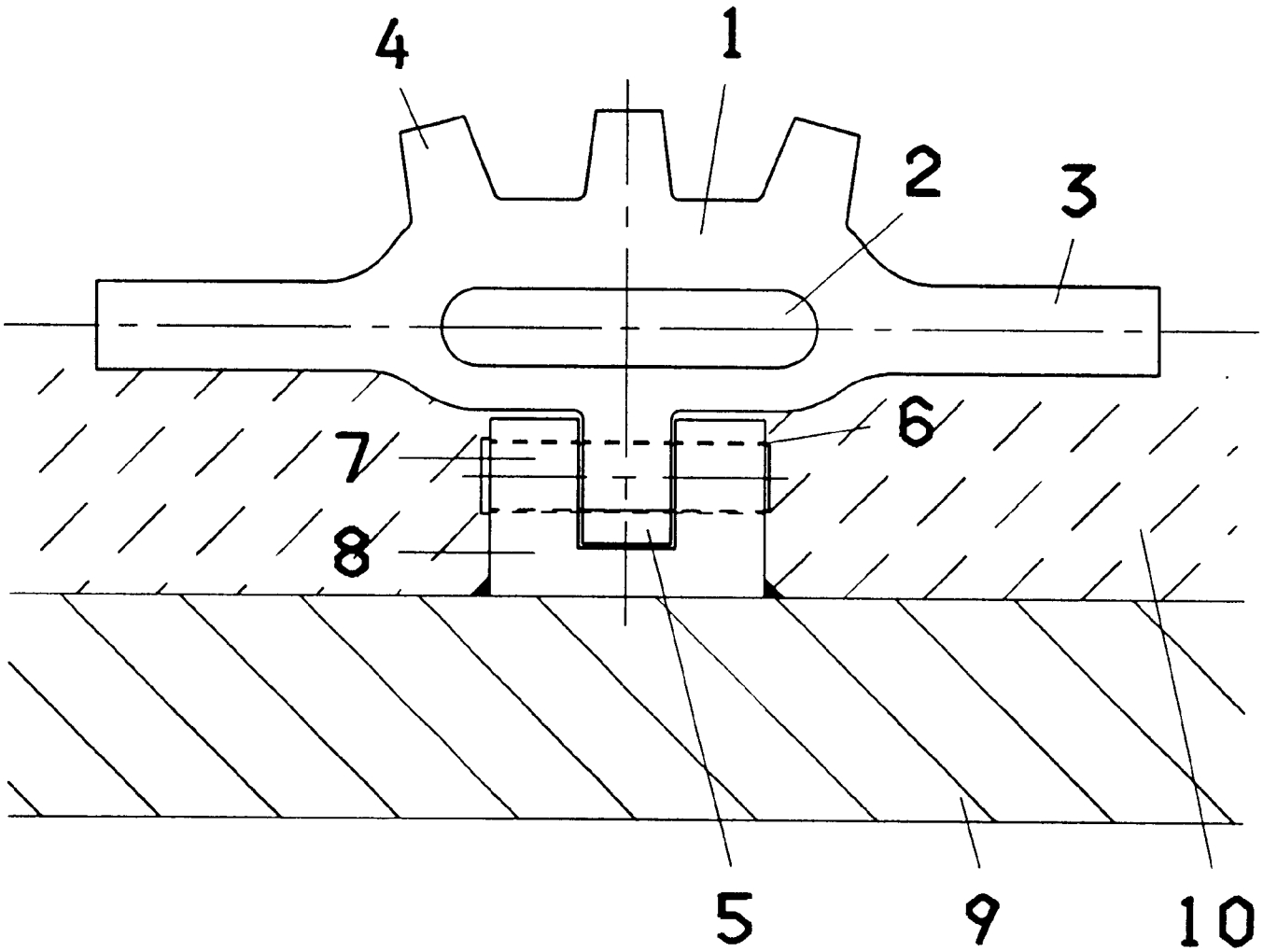
FIG. 1 is a cross-sectional view of a copper cooling element with slag ribs.

FIG. 1 of the drawing is a cross-sectional view of a cooling element 1 composed of an extruded or rolled section which in the interior thereof has one or more oblong cooling ducts 2 which may be round or have a shape which deviates from the circular shape.

The cooling element 1 is provided with lateral webs 3 and continuous slag ribs 4 are arranged on the side facing away from the blast furnace wall 9 and extending in the vertical direction. A fastening rib 5 is arranged on the side facing the blast furnace wall 9.

The cooling element 1 is fastened by means of bolts 7 in bores 6 of the fastening element 8, the blast furnace wall 9 and the fastening rib 5. The space between the cooling element 1 and the blast furnace wall 9 is filled with a refractory filling 10.

Figure 2:
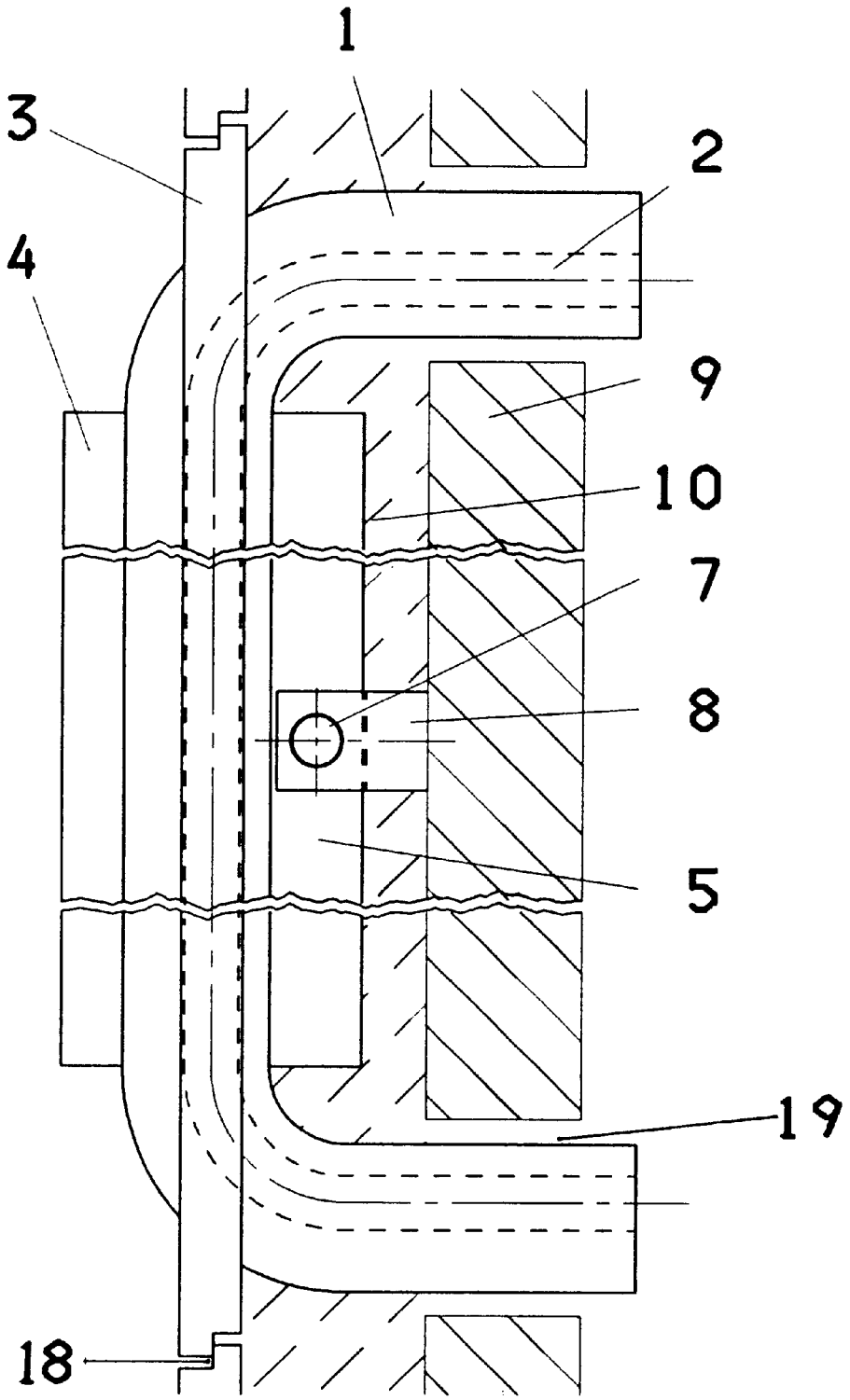
FIG. 2 is a side view of a copper element with slag ribs.

As illustrated in FIG. 2, the upper and lower ends of the cooling element 1 with the cooling duct 2 are bent by 90° in the direction toward the blast furnace wall 9 and extend through openings 19 of the blast furnace wall 9. The upper and lower webs 3 and the slag ribs 4 continue to extend vertically and have steps 18 at the ends thereof in order to be connected to the adjacent cooling element in such a way that the cooling elements cover the entire surface area of the blast furnace. The cooling element 1 is fastened to the blast furnace wall 8, 9 by a bolt 7 which extends through the fastening rib 5 and the fastening element 8.

Figure 3:
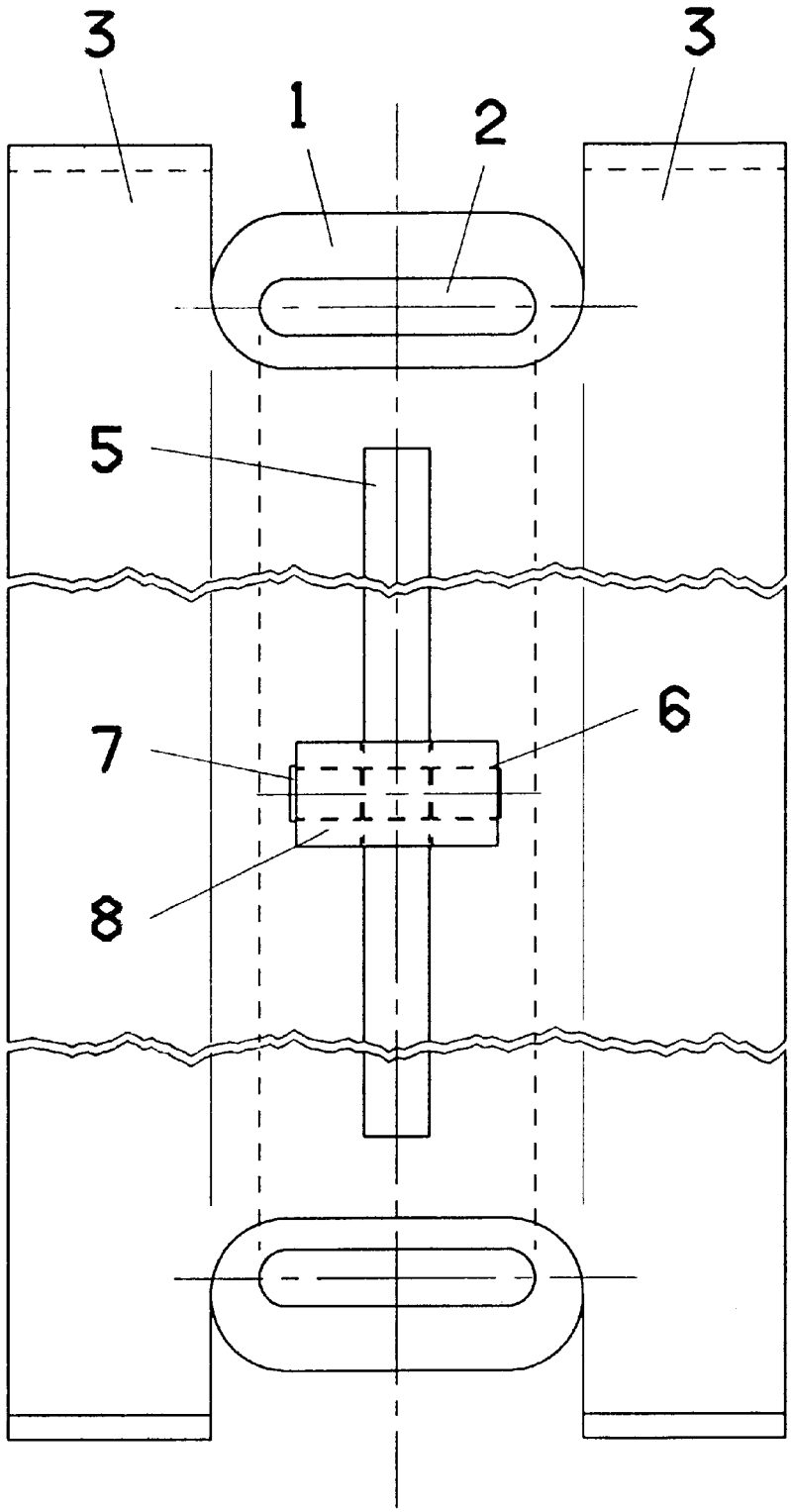
FIG. 3 is a longitudinal sectional view of a copper cooling element with slag ribs.

FIG. 3 of the drawing shows a longitudinal sectional view of the cooling element 1 with an oval cooling duct 2. An elongated fastening rib 5 is provided on the side facing the fastening element 8 of the blast furnace wall 9. A bolt 7 is inserted through a bore 6 in the fastening rib 5 and the fastening element 8 for fastening the cooling element to the blast furnace wall.

Figure 4:
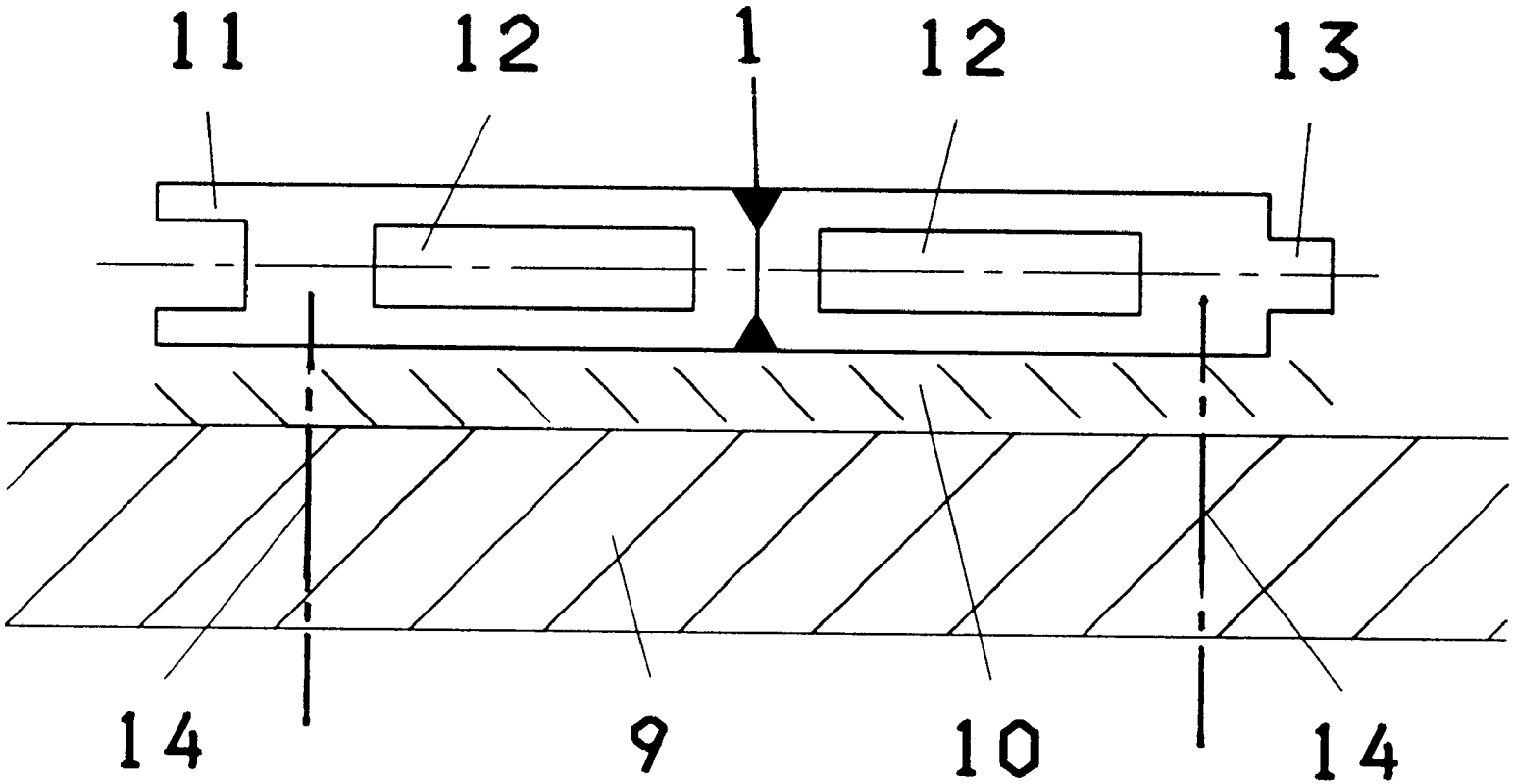
FIG. 4 is a cross-sectional view of a copper cooling element composed of rectangular sections.

FIG. 4 is a top view of another alternative embodiment of a cooling element 1 which is composed of a rectangular cooling element 11 with a groove and a rectangular cooling element 13 with a key, wherein a cooling duct 12 is formed in each rectangular cooling element 11 and 13.

The cooling element 1 is fastened to the steel jacket 9 of the blast furnace by means of fastening elements 14. A filling 10 of refractory material is filled between the cooling element 1 and the steel jacket of the blast furnace.

Figure 5:
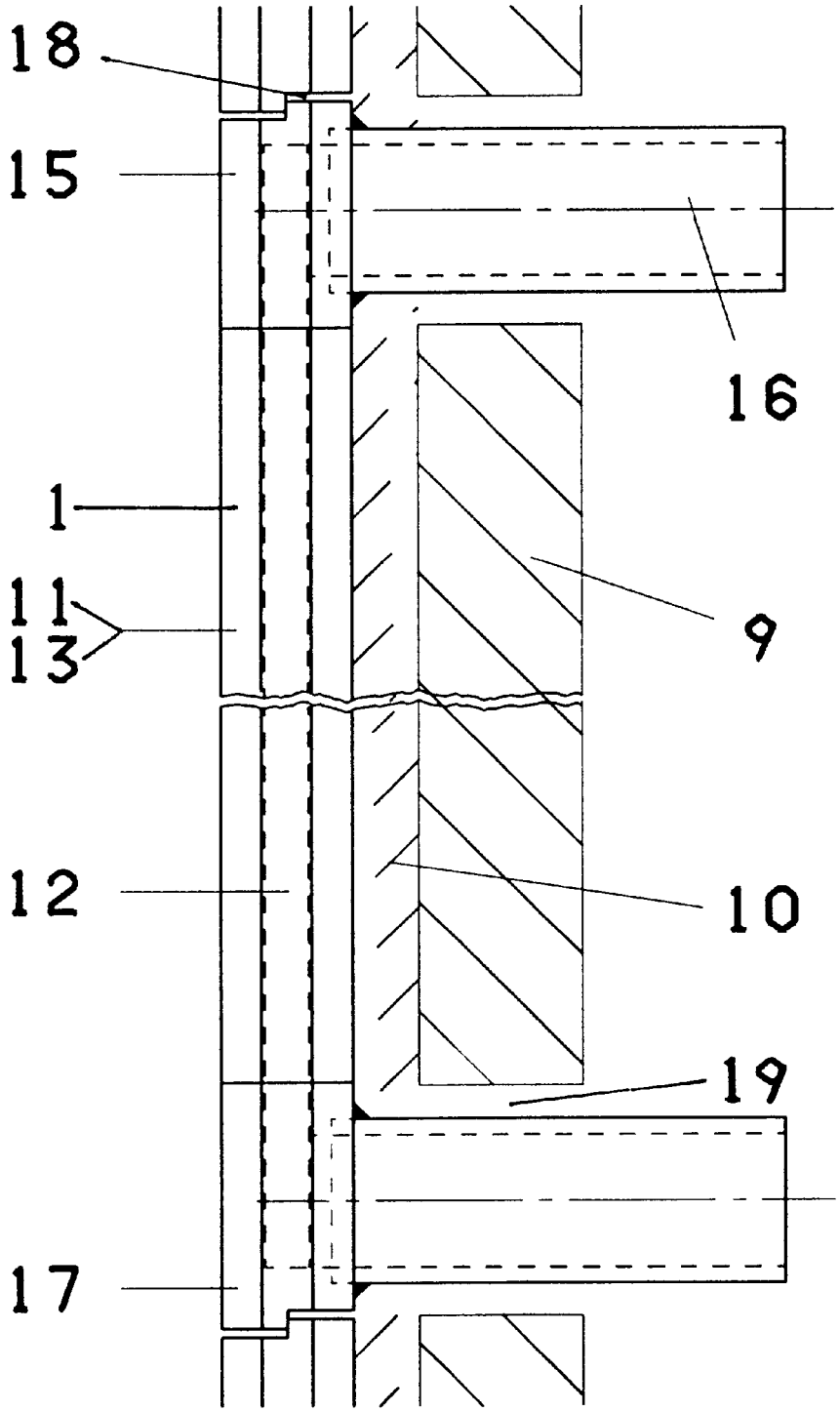
FIG. 5 is a side view of copper cooling elements of rectangular sections placed one on top of the other.

FIG. 5 is a side view of cooling elements 1, 11, 12, 13 fastened one above the other to the steel jacket 9 of the blast furnace. The cooling element 1 is covered in a pressure-tight manner by an upper cover 15 and a lower cover 17 provided with pipe pieces 16 for the supply and discharge of coolant.

Recesses or steps 18 provided offset relative to each other in the covers 15, 17 make possible an overlapping placement of the cooling elements 1 at the steel jacket 9 of the blast furnace.

Figure 6:
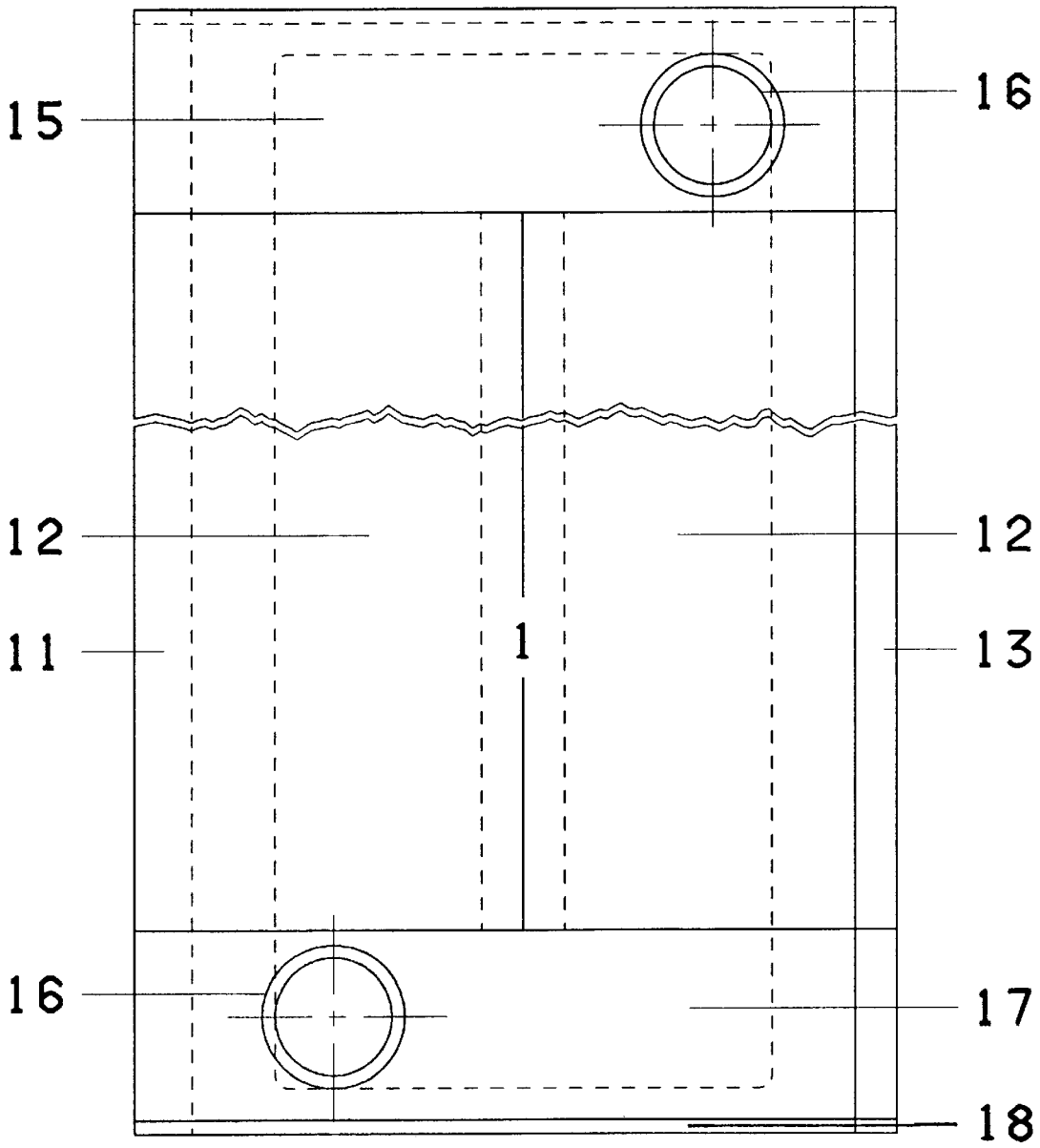
FIG. 6 is a longitudinal sectional view of a copper cooling element of rectangular sections.

FIG. 6 is a longitudinal sectional view of a cooling element 1 which is ready for assembly. This cooling element 1 is composed of a rectangular cooling element 11 with a groove, a rectangular cooling element 13 with a key and with upper and lower covers 15, 17, each provided with a pipe piece 16, and with a recess or step 18.

The cooling water enters through the pipe piece 16 in the lower cover 17 and, after flowing through the cooling ducts 12, leaves through the upper cover 15, 16.

Figure 7:
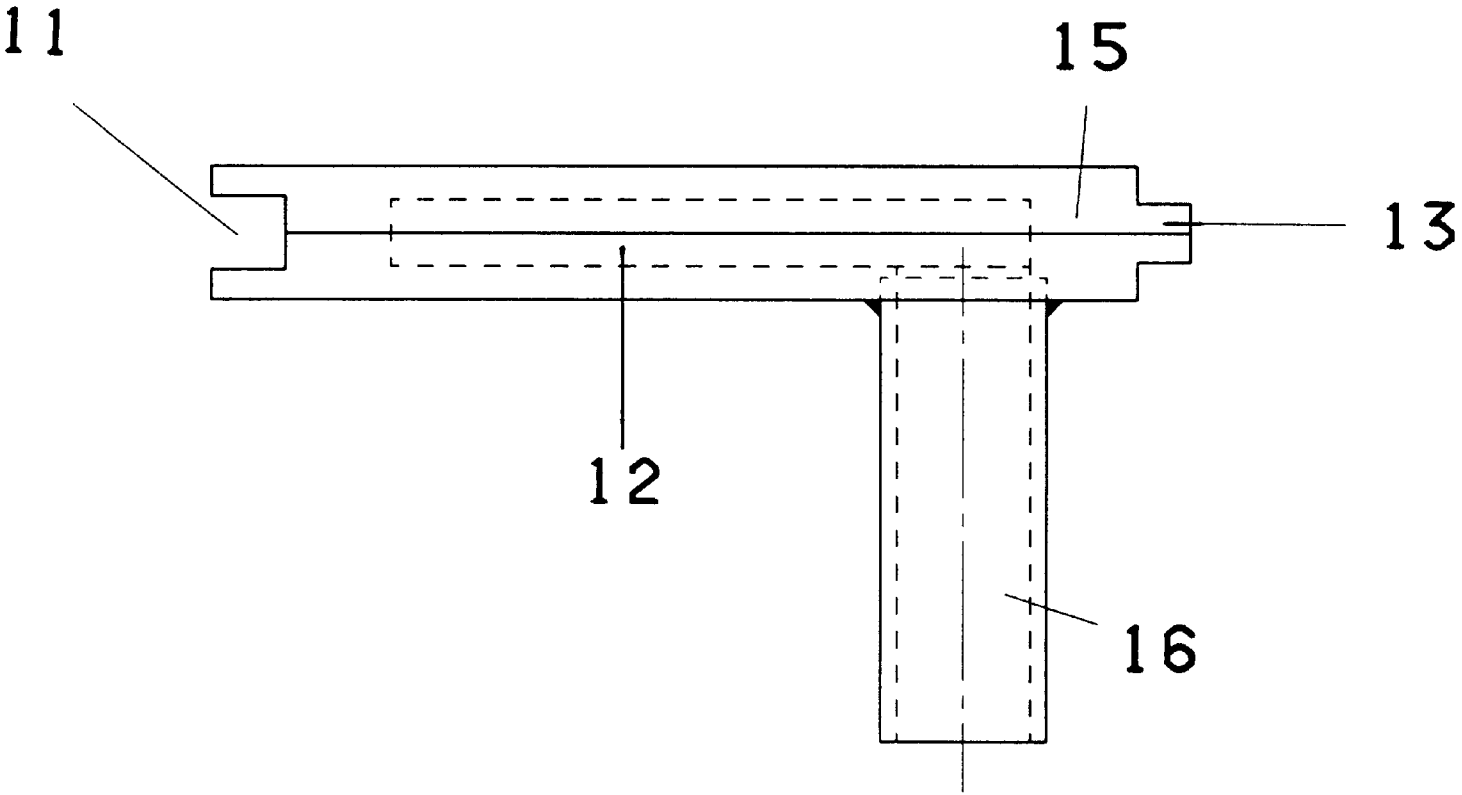
FIG. 7 is a top view of the upper cover of the copper cooling element of rectangular sections.
Figure 8:
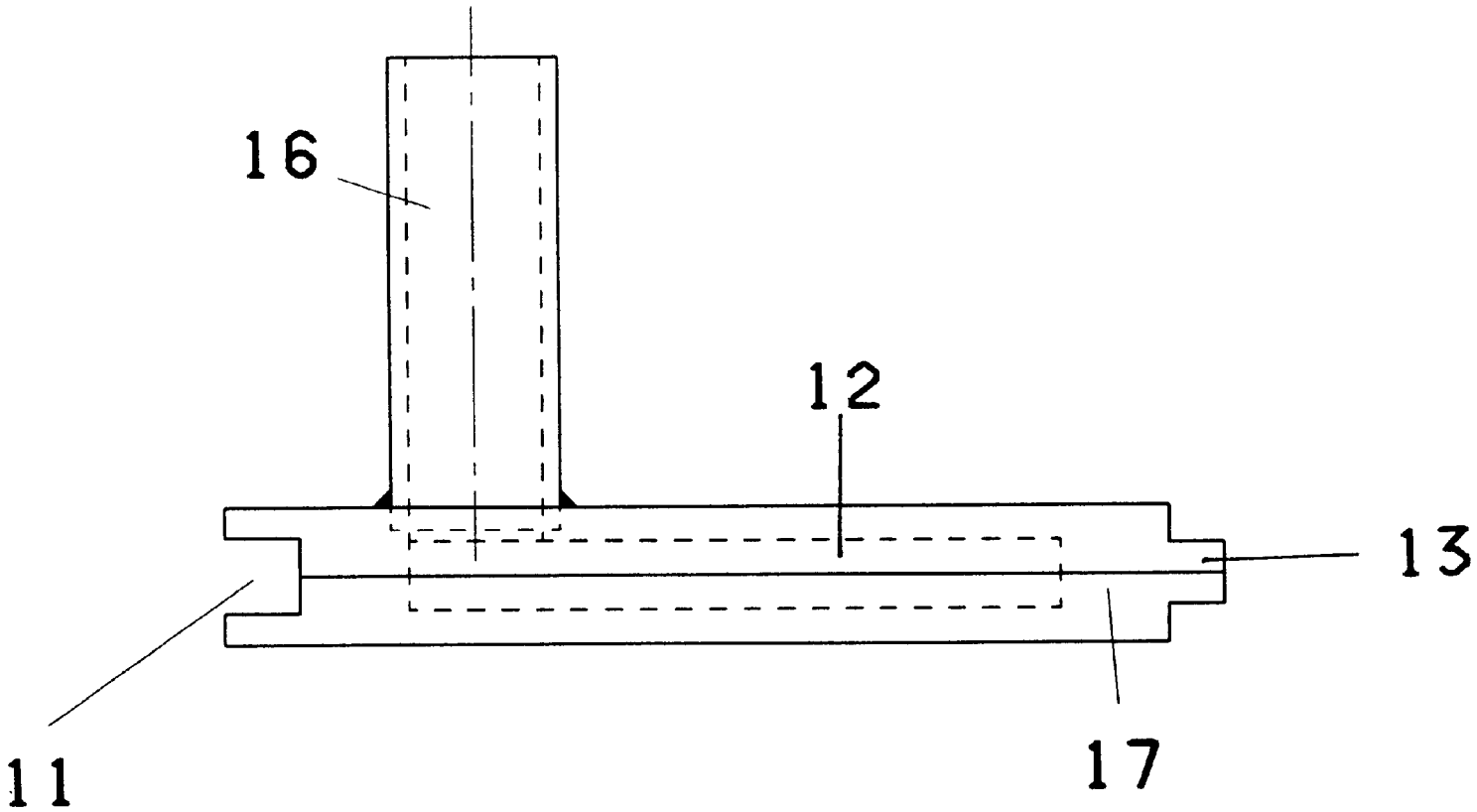
FIG. 8 is a top view of the lower cover of the copper cooling element of rectangular sections.

FIGS. 7 and 8 are top views of the upper cover 15 and the lower cover 17, respectively, each provided with a pipe piece 16 and segments of the cooling element 11 with a groove and a cooling element 13 with a key, each including the two cooling ducts 12.

While specific embodiments of the invention have been shown and described in detail to illustrate the inventive principles, it will be understood that the invention may be embodied otherwise without departing from such principles.

I claim:

1. A cooling element for shaft furnaces provided with a refractory lining, the cooling element being of copper or a low copper alloy, the cooling element being comprised of an extruded or rolled section having an interior, cooling ducts being formed in the interior of the cooling element, the cooling ducts having a round shape or a shape deviating from a circular shape, the cooling element comprising lateral webs, wherein the cooling element further comprises at least one continuous slag rib extending in the vertical direction on a first side of the cooling element facing away from a furnace wall, and at least one fastening rib on a second side of the cooling element facing the furnace wall, wherein the at least one fastening rib of the cooling element is connected through bolts to fastening elements of the furnace wall, and wherein the recesses of the webs of the cooling elements are arranged so as to overlap.

2. The cooling element according to claim 1, wherein the cooling element has upper and lower ends, wherein the cooling element including the cooling ducts is curved by 90° at the upper and lower ends in a direction toward the furnace wall, and wherein the upper and lower ends of the cooling element are separated from the lateral webs.

3. The cooling element according to claim 1, wherein the cooling element has on the side facing away from the furnace wall two or a plurality of slag ribs extending parallel to each other in the vertical direction.

4. The cooling element according to claim 1, wherein the fastening rib has at least one bore.

5. A cooling element for shaft furnaces provided with a refractory lining, the cooling element being of copper or a low copper alloy, the cooling element being comprised of an extruded or rolled section having an interior, cooling ducts being formed in the interior of the cooling element, the cooling ducts having a round shape or a shape deviating from a circular shape, the cooling element comprising lateral webs, wherein the cooling element further comprises at least one continuous slag rib extending in the vertical direction on a first side of the cooling element facing away from a furnace wall, and at least one fastening rib on a second side of the cooling element facing the furnace wall, wherein the at least one fastening rib of the cooling element is fastened through bolts to fastening elements of the furnace wall, and wherein the webs of the cooling elements are arranged flush with each other.

6. The cooling element according to claim 5, wherein the cooling element has upper and lower ends, wherein the cooling element including the cooling ducts is curved by 90° at the upper and lower ends in a direction toward the furnace wall, and wherein the upper and lower ends of the cooling element are separated from the lateral webs.

7. The cooling element according to claim 5, wherein the cooling element has on the side facing away from the furnace wall two or a plurality of slag ribs extending parallel to each other in the vertical direction.

8. The cooling element according to claim 5, wherein the fastening rib has at least one bore.

* * * * *